US005803231A

United States Patent [19]

Lauke

[11] Patent Number: 5,803,231

[45] Date of Patent: Sep. 8, 1998

[54] TRANSFER ARRANGEMENT WITH A THREE-AXLE TRANSFER

[75] Inventor: Andreas Lauke, Grubingen, Germany

[73] Assignee: Schuler Pressen GmbH & Co., Germany

[21] Appl. No.: 678,820

[22] Filed: Jul. 12, 1996

[30] Foreign Application Priority Data

Jul. 20, 1995 [DE] Germany ..... 195 26 490.8

[51] Int. Cl.[6] ..... B65G 25/00

[52] U.S. Cl. ..... 198/621.1; 414/751; 72/405.16

[58] Field of Search ..... 198/621.1; 414/751; 72/405.13, 405.16

[56] References Cited

U.S. PATENT DOCUMENTS

| | | | |
|---|---|---|---|
| 4,511,029 | 4/1985 | Okawa . | |
| 4,540,087 | 9/1985 | Mizumoto | 198/621.1 |
| 5,423,202 | 6/1995 | Komatsu et al. . | |
| 5,562,196 | 10/1996 | Zierpka et al. | 198/621.1 |

FOREIGN PATENT DOCUMENTS

| | | |
|---|---|---|
| 0 616 859 A1 | 3/1994 | European Pat. Off. . |
| 43 10 057 A1 | 9/1994 | Germany . |
| 61-99530 | 5/1986 | Japan . |
| 61-283426 | 12/1986 | Japan . |

*Primary Examiner*—Joseph E. Valenza
*Attorney, Agent, or Firm*—Evenson, McKeown, Edwards & Lenahan, P.L.L.C.

[57] ABSTRACT

A transfer arrangement includes a transfer unit constructed as a three-axle transfer unit. For two parallel, spaced gripper rails which are to be moved synchronously, stationarily disposed driving units are provided for the respective transport direction, the transverse direction and the stroke direction. The transverse driving unit acts by way of coupling devices upon the gripper rails to establish a driving connection between the transverse driving unit and the gripper rails only when these must be laterally adjusted. Otherwise, the transverse driving unit is separated from the gripper rails. Thereby, the masses, which are to be moved up and down with the gripper rails and the resulting acceleration forces are considerably reduced and shortened timing periods are permitted. The transverse driving unit 40 can be arranged below a plane defined by the gripper rails. For exchanging workpieces disposed on sliding tables, the gripper rails can move into a very lifted position without also having to lift the transverse driving unit, which otherwise would require a corresponding free space in the transfer arrangement.

18 Claims, 3 Drawing Sheets

TRANSFER ARRANGEMENT WITH A THREE-AXLE TRANSFER

BACKGROUND AND SUMMARY OF THE INVENTION

The present invention relates to a transfer arrangement, and more particularly, to a transfer arrangement for machining workpieces in machining stations aligned along a transport direction.

In transfer arrangements, workpieces which move in stages through several machining steps, are successively timed through several machining stations. These machining stations are set up behind one another along a transport direction and each carry out a special machining on the corresponding workpiece. For the transport of the workpieces from one machining station into the respective next machining station, the transfer arrangement has a transfer device which conveys the workpieces from machining station to machining station. A certain amount of time is required for this transport, i.e., for gripping a workpiece, guiding out of a machining station, transport to the respective next machining station, insertion of the workpiece into this machining station and separating of the transfer device from the workpiece. This time period must be taken into account during the determination of the total time which is required for the concerned workpiece. In other words, the resulting transport time for the workpiece results in a timing sequence which should be as fast as possible in order to permit a high output of the transfer arrangement.

Furthermore, the machining stations of transfer arrangements are frequently provided with voluminous exchangeable tools which, for example, particularly in press stations, are disposed on sliding tables. In order to permit a tool change without problems, the transfer device must allow sufficient free space.

DE-43 10 057 A1 describes an arrangement for transferring workpieces through a succession of machining stations which are linked with one another. This arrangement is constructed as a three-axle transfer and has two gripper rails which are spaced parallel to one another. These rails are arranged in a horizontal plane and are equipped with gripping devices which can be engaged with and disengaged from the workpieces to be transported.

The gripper rails of this known arrangement are suspended by linear guides on vertically adjustable cross members. The linear guides permit a longitudinal movement of the gripper rails, in which case, stationarily disposed electric transport driving units are provided for driving the gripper rails in the longitudinal direction. The driving units, which are constructed as linear drives, are connected for the uncoupling with respect to the respective height of the gripper rails by way of coupling rods with the gripper rails.

In order to be able to lift and lower the gripper rails in a targeted manner in the known arrangement, motors, by way of suitable transmissions, cause a lifting and lowering of the cross members. For the opening and closing of the gripper rails, i.e., a movement toward one and away from one another, electric motors are arranged on the cross members which, by way of transmissions, cause a lateral adjustment of the gripper rails.

For carrying out a single transfer cycle, the cross traverses in the known arrangement must be lifted and lowered and the gripper rails must be moved longitudinally. In this case, the corresponding masses must in each case be accelerated and braked. In the case of the lifting and lowering movement, not only the gripper rails and the tools hanging thereon must be moved but also the cross traverses with the electric motors and the transmissions mounted thereon. The inertial forces to be overcome require a correspondingly high driving energy and limit the working speed.

During the tool change, i.e., during the lateral moving-out of sliding tables arranged in the area of the working stations, the gripper rails must be adjusted into an uppermost lifted position in order to permit the lateral passage of the sliding table with the tools deposited thereon (top tool and bottom tool of a press) under the gripper rails. The electric motors and transmissions disposed on the cross member for this purpose require a corresponding free space which should be taken into account when the transfer arrangement is constructed. As a result, an additional height of the transfer arrangement may be required.

An object of the present invention is to provide a transfer arrangement with machining stations and a transfer device which permits short cycle times and a facilitated tool change.

This object has been achieved according to the present invention by a transfer arrangement in which the transport driving unit, the stroke driving unit and the transverse driving unit are each stationary, a coupling device is provided between the transverse driving unit and the gripper rails, and a drive of the transverse driving unit is operatively coupled with the gripper rails only when the latter are in a fixed position with respect to the stroke direction and otherwise are separated from the gripper rails.

For driving its two, mutually parallel gripper rails in three mutually independent axial directions, the transfer arrangement has three separate, preferably electrically driven driving units, namely the transport driving unit, the stroke driving unit and the transverse driving unit. All driving units are stationarily disposed in a mutually independent manner so that none of the driving units as a whole must be accelerated or braked. During a transport cycle, only the gripper rails and possibly existing holding devices, such as cross members or the like, are accelerated and braked but not the driving units.

While the transport driving unit and the stroke driving unit are in a continuous driving connection with the gripper rails, the transverse driving unit can at times be separated from the gripper rails. For this purpose, coupling devices are provided, with the gripper rails being separated from the transverse driving unit in a transport cycle. The coupling devices each contain two coupling halves transmitting translational movements. Only coupling halves which have a small mass remain connected with the gripper rails. In comparison to the prior art arrangements, the total mass of the moved parts in the present invention is significantly reduced and permits an increase of the working speed of the transfer device.

The present invention is based on a recognition that a transverse movement (opening and closing of the gripper rails) is required only in a fully lowered position of the gripper rails. In this position, the gripper rails or their gripping devices are engaged with and disengaged from the workpieces. The gripper rails will then carry out the actual working or return stroke in the lifted position. In the fully lowered position, the gripper rails are connected with the transverse driving unit so that a lateral adjusting is possible in this position. The stationary bearing, particularly the transverse driving unit, simplifies the energy supply and the lubrication of the driving unit.

The overall height of the parts connected with respect to the stroke direction with the gripper rails is low which, inversely permits a particularly large stroke in the vertical or stroke direction. Advantageously, no disturbing superstructural parts are situated on the cross members. This is particularly advantageous during the tool change. The gripper rails can be lifted particularly far, so that the tool change becomes very simple because of the lateral moving-out of the sliding tables.

In a basic embodiment of the present invention, the gripper rails are connected with a braking device which will block it in the transverse direction when the gripper rails are separated from the transverse driving unit. The transition from the release position into the clamping or blocking position preferably takes place during or shortly before, the separating of the coupling halves. Thereby, during their movement, the gripper rails maintain a distance from one another which is equal to the distance adjusted by the transverse driving unit. The braking device may be a clamping device as well as a detent or locking device. A clamping device has advantages if a continuous adjustability of different distances of the gripper rails from one another is desired, while a detent device or a locking device is advantageous when only two or a few positions of the gripper rails are to be fixed.

The braking device is preferably controlled by a sensor device which senses whether the gripper rails are already coupled to the transverse driving unit or are separated therefrom. This can be achieved advantageously by monitoring the distance of the gripper rails from the transverse driving unit. The sensor device can also directly monitor the coupling device. A simple construction of the sensor device can be a sensing lever which, when the coupling halves approach one another, is swivelled out of its inoperative position, thereby releasing the braking device.

The braking device can be constructed as a linear braking unit, in which a brake block, which is resiliently prestressed toward its engaged position, is supported on an oblong brake surface and is relieved from the spring force or lifted from the brake surface by the sensing lever when the sensing lever is swivelled out of its inoperative position.

The uncoupling of the gripper rails from the cross members with respect to the stroke direction can be taken over by a linear guide. In contrast to coupling rods or coupling rocker arms, this linear guide provides a complete uncoupling of movement directions which are at a right angle with respect to one another. Another linear guide for the transverse direction permits a displacement of the gripper rails with respect to the cross members in the lateral direction. Although rocker arm suspensions or similar devices can also be used for the uncoupling, the linear guides permit a lower overall height. Both linear guides are connected by an intermediate piece with the coupling half assigned to the gripper rail preferably provided on this intermediate piece.

The coupling device couples the gripper rail with respect to a linear movement in the lateral direction with the transverse driving unit and can, for example, be formed by a sleeve and a pin whose respective longitudinal direction extends transversely to the transverse movement direction to be transmitted. Such a coupling can be engaged and disengaged in a particularly simple manner.

In principle, the driving units can be mechanical driving units, but it is also advantageous for them to be driven by respective separate electric motors. As a result, the movement components in the transport, stroke and transverse direction can be separately controlled, thereby permitting a facilitated adjustment and possibly a reprogramming of transfer curves.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
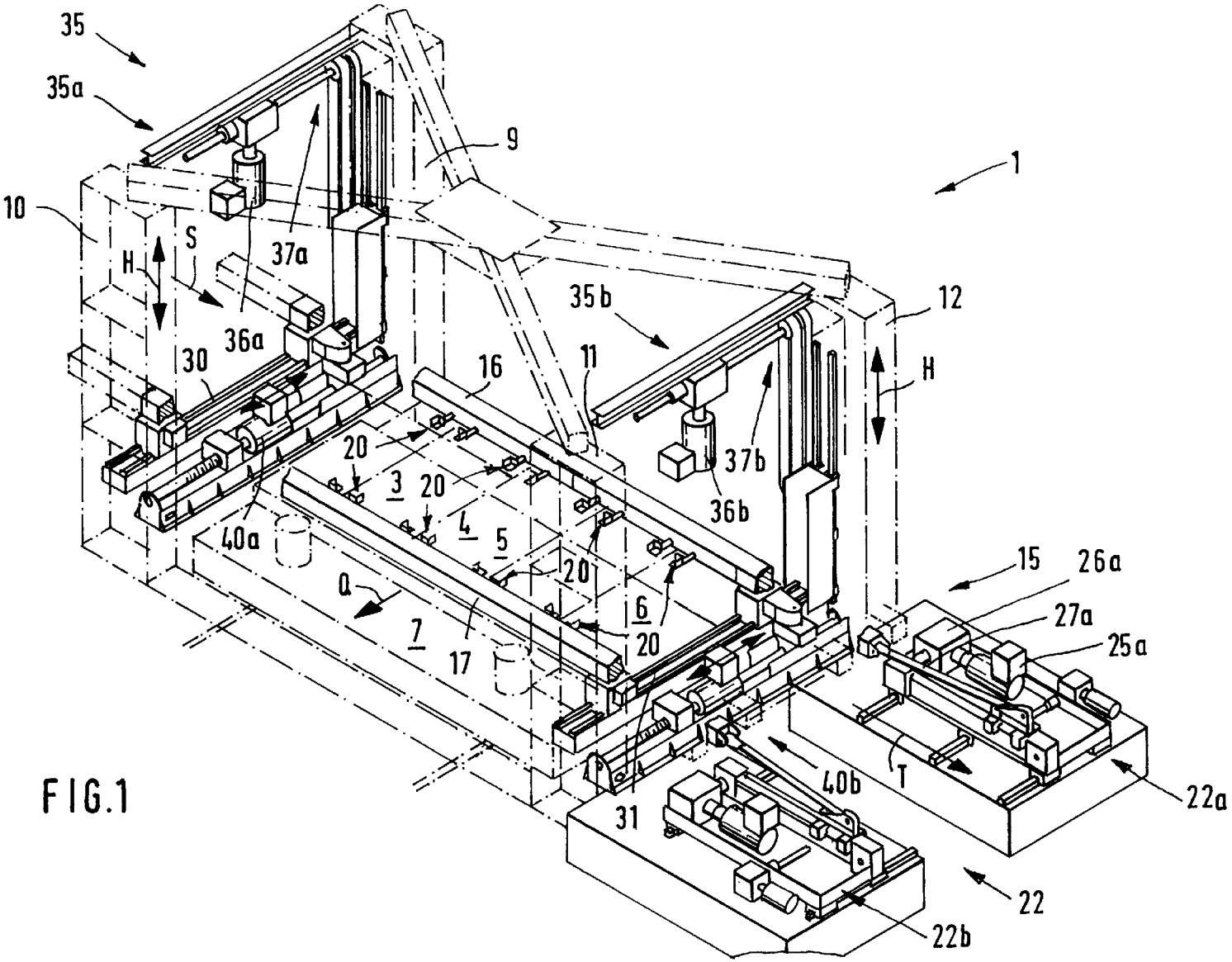
FIG. 1 is a schematic and cutout-type perspective view of a transfer arrangement with a three-axle transfer unit in accordance with the present invention in which separate, stationarily disposed driving units are used for the transport direction, the transverse direction and the stroke direction.

The transfer arrangement illustrated in FIG. 1 is a transfer press designated generally by numeral 1 which has four press stations 3, 4, 5, 6 as machining stations which are arranged along a transport direction T. The press stations 3, 4, 5, 6 are each illustrated only schematically by a long-short dashed line extending transversely to the transport direction T. The press stations 3, 4, 5, 6 include corresponding bottom tools (not shown in detail) arranged on a common sliding table 7. The bottom tools are, for example, bottom dies for deforming large-surface workpieces consisting of sheet metal in a generally known manner.

Top tools are assigned to the respective bottom tools and are releasably held on slides which synchronously move up and down in a timed manner. The slides are driven by eccentrics which are disposed in the machine frame which is only outlined by four corner pillars 9, 10, 11, 12. During each working cycle, the top tools, which are constructed in a complementary manner with respect to the bottom tools, deform workpieces which lie on the bottom tools and must then be conveyed to the respective next press station in order to obtain the desired shape in a step-by-step fashion, again in a generally known manner.

The sliding table 7 is arranged to be moved out of the machine frame in the transverse direction Q in order to exchange, as required, the bottom tools and the top tools which are detached from the slides and deposited on the bottom tools. The transverse direction Q is a horizontal direction which is fixed at a right angle with respect to the transport direction T.

Gripper rails 16, 17, which belong to a transfer unit 15, are spaced, i.e. held at a distance, parallel to one another and whose longitudinal direction coincides with the transport direction T, extend through the press stations 3, 4, 5, 6. The gripper rails 16, 17 situated in a common horizontal plane are each provided with grippers 20. A targeted lateral movement of the gripper rails 16, 17 in the transverse direction Q toward one another and away from one another, allows the grippers 20 to be engaged with and disengaged from the transported workpieces.

For the movement of the gripper rails 16, 17 into and against the transport direction T, a transport driving unit 22 is provided which contains a driving unit 22*a* for the gripper rail 16 and a driving unit 22*b* for the gripper rail 17. Like the remaining transfer unit 15, the driving units 22*a*, 22*b* are constructed symmetrically with respect to one another with respect to a longitudinally and vertically extending center plane. The driving unit 22*a* has an electric motor 25*a* whose rotating movement is converted by a corresponding transmission 26*a* into a linear movement. For the coupling of the transmission 26*a* with the gripper rail 16, a coupling rod 27*a* transmits a longitudinal movement in the transport direction T from the transmission 26*a* to the transport rail 16 and thereby permits an adjustments of the gripper rail 16 in the transverse direction Q as well as in a stroke direction H. A corresponding arrangement is provided for the driving unit 25*b* and the gripper rail 17. The coupling rods 27*a*, 27*b* can be replaced by linear guides with a vertical axis, so that the movements in the stroke and in the transport direction are uncoupled from one another.

By way of linear guides explained below, the gripper rail 16 is disposed on two cross members 30, 31 which are spaced or held at a distance parallel to one another and extend in the transverse direction Q. Thereby, the cross members 30, 31 can be adjusted in the transport direction T as well as in the transverse direction Q, and in the stroke direction H are connected to the cross member 30, 31. Correspondingly, the gripper rail 17 is disposed by way of linear guides on the cross members 30, 31.

In order to be able to impose a movement component in the stroke direction H, on the gripper rails 16, 17 in a synchronous manner the cross members 30, 31 can be vertically adjusted, with a stroke driving unit 35 being provided for driving the cross members. The stroke driving arrangement designated generally by numeral 35 contains a driving unit 35*a* which is stationarily disposed on the corner pillars 9, 10 and has an electric motor 36*a* which, by way of a transmission device 37*b*, acts upon the cross member 30. The driving arrangement 35 further includes a driving unit 35*b* which has an electric motor 36*b* and a transmission device 37 for converts rotating movement of the motor shaft into a linear movement and connecting the electric motor 36*b* with the cross member 31.

Figure 2:
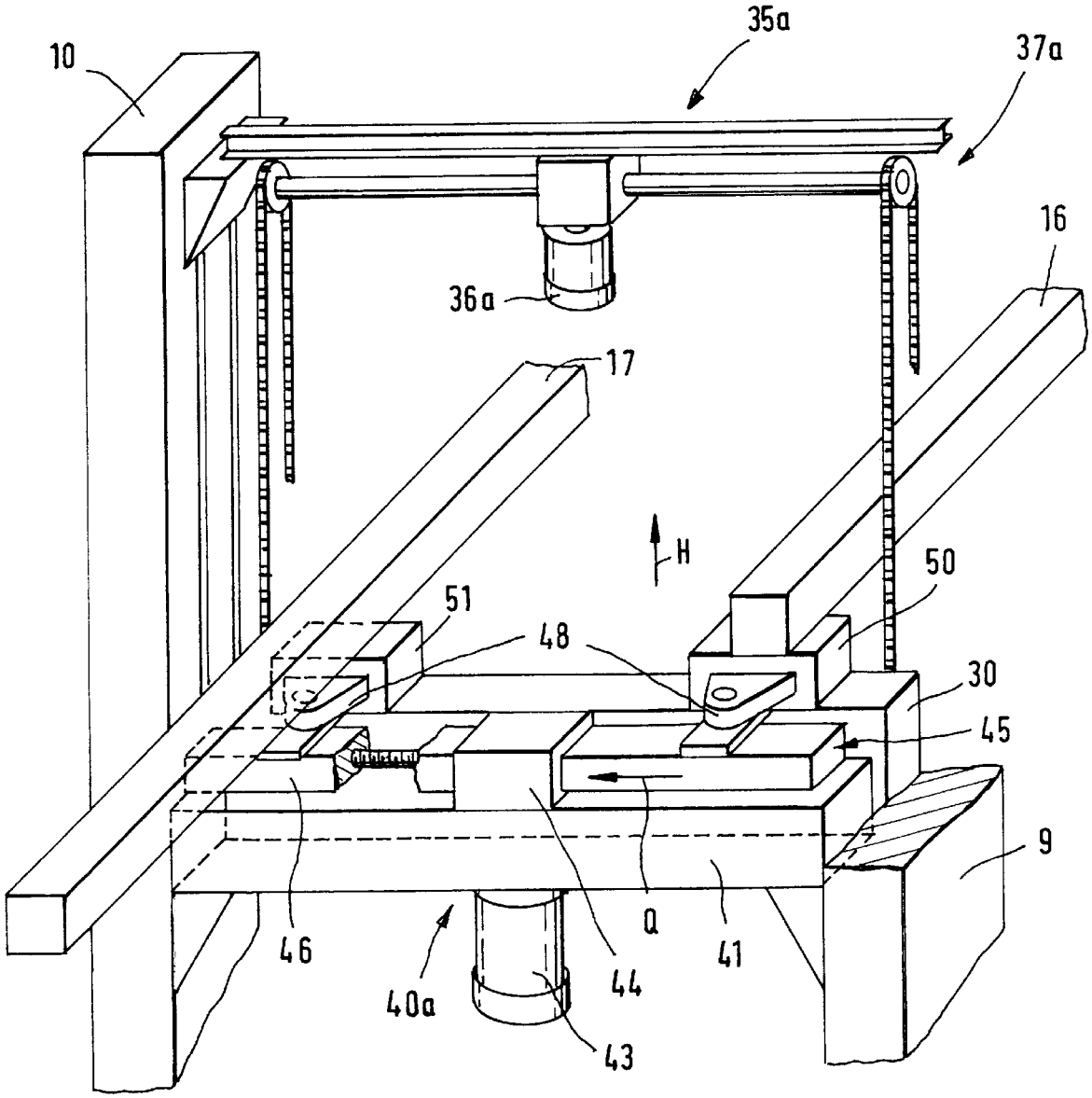
FIG. 2 is a partial perspective view of the transfer unit according to FIG. 1.

For adjusting the gripper rails 16, 17 toward and away from one another, i.e., in the transverse direction Q, a transverse driving arrangement designated generally by numeral 40 is provided and contains a driving unit 40*a* assigned to the cross member 30 and a driving unit 40*b* assigned to the cross member 31. Both driving units 40*a*, 40*b* have essentially the same construction, and hence only the details of the driving unit 40*a* are explained with reference to FIG. 2.

Figure 3:
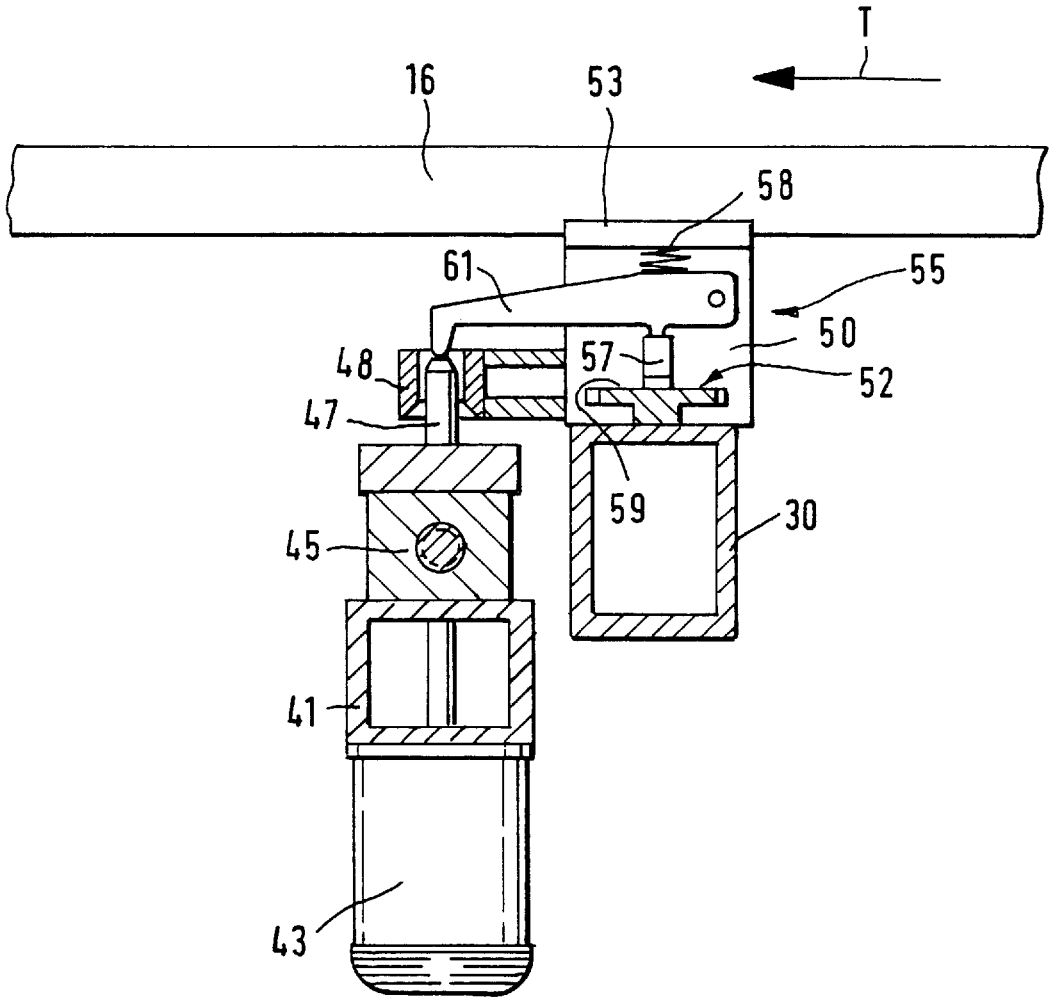
FIG. 3 is an elevational sectional, partial schematic view of the transfer unit according to FIG. 2.

Between the corner pillars 9, 10, the driving unit 35*a* belonging to the stroke driving arrangement 35 as well as the driving unit 40*a* which belongs to the transverse driving arrangement 40 are arranged. A support 41 is provided parallel to the cross member 30, which can be lifted and lowered in the stroke direction H by the driving unit 35*a* and the chain of the transmission device 37*a*. The support 41 is fastened on the end side on the corner pillars 9, 10 and has an electric motor 43 on its bottom side. By way of an angle transmission 44; the electric motor 43 drives a spindle drive 45 which is assigned to the gripper rail 16, as well as a spindle drive 46 which is assigned to the gripper rail 17. As seen in FIG. 3, the spindle drive 45 is provided with a pin 47 as an output so that when the motor 43 is operating, the spindle drive 45 is displaced parallel along the transverse direction Q, whereas the longitudinal direction of the pin 47 is in the stroke direction H.

Likewise, the spindle drive 46 is provided with a pin 47 as an output which is parallel to the pin 47. During the operation of the motor 43, the pins move toward one another or away from one another. The pins 47 are used as coupling halves to which corresponding sleeves 48 are assigned as complementary coupling halves. The coupling devices, which are each formed by the pins 47 and the sleeves 48, are used for coupling the gripper rails 16, 17 to a corresponding movement of the pins 47 in and against the transverse direction Q.

The coupling halves formed by the sleeves 48 are fixedly connected with intermediate pieces 50, 51 which, by way of linear guides 52 indicated, for example, in FIG. 3, are disposed on the cross member 30 and can be displaced in the transverse direction Q. By way of a linear guide 53 arranged at a right angle thereto, the gripper rail 16 is connected with the intermediate piece 50. A corresponding linear guide is provided between the intermediate piece 51 and the gripper rail 17.

The intermediate piece 50 and the linear guide 52 can be blocked by a corresponding braking device designated generally by numeral 55 which contains a brake shoe 57. By way of a pressure spring 58, the brake shoe 57 can be pressed against a brake surface 59 fixed with respect to the cross member 30. In contrast, the brake shoe 57 is connected with the movable intermediate piece 50. The braking device 55 also includes a sensing lever 61 which, at one end, is swivellably disposed on the intermediate piece 50 and transmits the spring force of the pressure spring 58 to the brake shoe 57. The free end of the sensing lever 61 projects into the interior of the sleeve 48.

In operation, the slides of the press stations 3, 4, 5, 6, of the transfer press determine a working cycle of the transfer press 1 in which the workpieces are to be transferred by the transfer unit 15 from press station to press station. This is carried out by the gripper rails 16, 17 which carry out a transfer movement. For this purpose, starting from a lowered condition of the cross members 30, 31, in which the sleeves 48 are disposed on the pins 47 and therefore establish a driving connection between the transverse driving unit 40 and the gripper rails 16, 17, a closing movement is triggered. During this closing movement, the transverse driving unit 40 moves the gripper rails 16, 17 toward one another so that their grippers 20 engage with the workpieces.

As soon as the grippers engage the workpieces to hold the latter securely, the stroke driving unit 35 is controlled so that the gripper rails 16, 17 will synchronously start to lift. Even before the sleeves 48 have completely lifted off the pins 47, the sensing levers 61, which are assigned to each coupling device, are swivelled into their non-operative position in which they no longer rest against the pin 47 and transmit the full force of the pressure spring 58 to the respective brake shoe 57. As a result, the gripper rails 16 17 are arrested in the transverse direction Q when the sleeves 48 are lifted off the pins 47.

By controlling the transport driving unit 22, the gripper rails 16, 17 now carry out a movement in the transport direction T and in the process transport the workpieces to the respective next processing station. This movement is permitted by the linear guides 53. The cross members 30, 31 and the associated intermediate pieces 50, 51 remain in place.

When the movement in the transport direction is completed or almost completed, the stroke driving unit 35 will lower the cross members 30, 31, whereby the sleeves 48 will again be disposed on the pins 47. Shortly before the end of the lowering movement, the pins 47 come to rest on the front side on the sensing levers 61 and therefore change the braking device 55 into the release position. By controlling the transverse driving unit 40, the gripper rails 16, 17 are moved away from one another, whereby the gripping devices 20 release the workpieces inserted into the corresponding tools.

During the subsequent machining operation of the workpieces in the machining or press stations 3, 4, 5, 6, the gripper rails 16, 17, by way of a corresponding control of the transport driving device 22, are returned into their starting position, after which the above-described transfer cycle of the transfer unit is repeated.

In summary, the transfer arrangement of the present invention has a transfer unit which is constructed as a three-axle transfer unit. For each of two synchronously moving gripper rails, which are spaced parallel to each other, stationarily disposed driving units are provided for movement in the transport direction, the transverse direction and the stroke direction. The transverse driving unit acts by way of coupling devices on the gripper rails which only establish a driving connection between the transverse driving unit and the gripper rails when these must be laterally adjusted. Otherwise, the transverse driving unit is separated from the gripper rails. The masses, which are to be moved up and down with the gripper rails and the resulting acceleration forces are thereby considerably reduced with shortened timing periods. In addition, it therefore becomes possible to arrange the transverse driving unit below a plane defined by the gripper rails. For exchanging workpieces disposed on sliding tables, the gripper rails can move into a very lifted position without the requirement of also lifting the transverse driving unit which otherwise would require a corresponding free space in the transfer arrangement.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A transfer arrangement for machining workpieces in a plurality of machining stations succeeding one another along a transport direction, comprising a transfer unit configured to transport the workpieces from one of the machining stations to another of the machining stations, gripper rails selectively spaced from and parallel to one another, and arranged in the transport direction so as to be, while in a spaced apart position, adjustable at a right angle in a transverse direction to the transport direction in the transverse direction for carrying out a transfer movement in the transport direction, a transport driving unit for driving the gripper rails synchronously with respect to one another along the transport direction, a stroke driving unit for driving the gripper rails at a constant distance with respect to one another at a right angle along a stroke direction with respect to the transport direction, and a transverse driving unit for driving the gripper rails toward and away from one another in the transverse direction, wherein the gripper rails have gripping devices adapted to be engaged with and disengaged from the workpieces, the transport driving unit, the stroke driving unit and the transverse driving unit are each stationary, a coupling device is provided between the transverse driving unit and the gripper rails, and a drive of the transverse driving unit is operatively coupled with the gripper rails only when the latter are in a fixed position with respect to the stroke direction and otherwise are separated from the gripper rails.

2. The transfer arrangement according to claim 1, wherein the fixed position is a lowest extreme position of the gripper rails with respect to the stroke direction.

3. The transfer arrangement according to claim 1, wherein the gripper rails are operatively connected with a braking device such that movement of the latter is prevented in the transverse direction in a position in which the gripper rails are separated from the transverse driving unit.

4. The transfer arrangement according to claim 3, wherein the braking device is a linear braking unit arranged to be prestressed toward a blocking position thereof by a spring device.

5. The transfer arrangement according to claim 3, wherein the braking device comprises a sensor device for sensing a distance of the gripper rails from the transverse driving unit, releasing the braking device when the distance falls below a predetermined limit and otherwise activating the braking device.

6. The transfer arrangement according to claim 3, wherein the braking device comprises a sensor device for monitoring the coupling devices and releasing the braking device in an engaged position of the coupling devices, and also for activating the braking device in a separated position of the coupling devices.

7. The transfer arrangement according to claim 5, wherein the sensor device is a sensing lever swivellably disposed about an axis connected to the gripper rails with respect to the stroke movement, and a free end of the sensing lever, for activating the braking is arranged to contact an element stationary with respect to the stroke direction for activating the braking device.

8. The transfer arrangement according to claim 6, wherein the sensor device is a sensing lever swivellably disposed about an axis connected to the gripper rails with respect to the stroke movement, and a free end of the sensing lever, for activating the braking is arranged to contact an element stationary with respect to the stroke direction for activating the braking device.

9. The transfer arrangement according to claim 1, wherein the gripper rails are fixedly coupled on at least two vertically adjustable and spaced cross members with respect to the stroke direction.

10. The transfer arrangement according to claim 9, wherein a drive of the stroke driving unit is operatively connected with the cross members.

11. The transfer arrangement according to claim 1, wherein, a first linear guide is arranged between the gripper rail and one of the cross members, and has a movement direction coincident with the transverse direction, and, a second linear guide between the gripper rail and another of the cross member, and has a movement direction coincident with the transport direction.

12. The transfer arrangement according to claim 11, wherein the coupling device has a first coupling half which, by way of the second linear guide, is operatively connected with the gripper rail, and has a second coupling half operatively is connected with the transverse driving unit.

13. The transfer arrangement according to claim 1, wherein the gripper rail is operatively connected with a coupling half configured as a sleeve having an opening oriented in the stroke direction, and the transverse driving device is operatively connected with a coupling half configured as a pin and sized to extend with slight play into the sleeve in the stroke direction.

14. The transfer arrangement according to claim 13, wherein the sensor device is a sensing lever swivellably disposed about an axis connected to the gripper rails with respect to the stroke movement, and a free end of the sensing lever, for activating the braking is arranged to contact an element stationary with respect to the stroke direction for activating the braking device.

15. The transfer arrangement according to claim 14, wherein the element is the pin.

16. The transfer arrangement according to claim 1, wherein the stroke driving unit is an electric linear driving unit.

17. The transfer arrangement according to claim 1, wherein the transverse driving unit is an electric linear driving unit which, when the gripper rails are coupled with the transverse driving unit, allows synchronous movement of the gripper rails toward and away from one another.

18. The transfer arrangement according to claim 1, wherein the transport driving unit has linear driving units connected with the gripper rails for synchronously moving the gripper rails in the transport direction independently of the position of the gripper rails with respect to the transverse direction and the stroke direction.

* * * * *